US011752474B1

(12) United States Patent
Law

(10) Patent No.: US 11,752,474 B1
(45) Date of Patent: Sep. 12, 2023

(54) FLUID REFINING SYSTEMS AND METHODS

(71) Applicant: Coactus, LLC, Spring, TX (US)

(72) Inventor: Mark Law, Montgomery, TX (US)

(73) Assignee: Coactus, LLC, Spring, TX (US)

( * ) Notice: Subject to any disclaimer, the term of this patent is extended or adjusted under 35 U.S.C. 154(b) by 0 days.

(21) Appl. No.: 18/108,380

(22) Filed: Feb. 10, 2023

(51) Int. Cl.
*B01F 27/27* (2022.01)
*B01F 27/272* (2022.01)

(52) U.S. Cl.
CPC ..... *B01F 27/272* (2022.01)

(58) Field of Classification Search
CPC ..... B01F 27/272
See application file for complete search history.

(56) References Cited

U.S. PATENT DOCUMENTS 3,444,784 A * 5/1969 Wengerd ..... F15B 15/065 91/533
3,616,375 A 10/1971 Inoue
5,487,873 A 1/1996 Bridges et al.
6,835,303 B2 12/2004 Mahajan
7,081,196 B2 7/2006 Cullen
7,871,501 B2 1/2011 Gondal et al.
8,197,763 B2 6/2012 Yen et al.

FOREIGN PATENT DOCUMENTS

CN 204029946 U 12/2014
KR 101813404 B1 12/2017

* cited by examiner

*Primary Examiner* — Waqaas Ali
(74) *Attorney, Agent, or Firm* — Quisenberry Law PLLC

(57) ABSTRACT

Fluid refining systems and methods are disclosed. A fluid refining apparatus may include an upper motor connected to an upper housing, and a lower motor connected to a lower housing. A central housing may be connected between the upper and lower housing. An upper shaft may be connected to the upper motor and rotatably disposed within the upper housing. A lower shaft may be connected to the lower motor and rotatably disposed within the lower housing. A group of nested upper cylinders may be connected to the upper shaft. A group of nested lower cylinders may be connected to the lower shaft. The group of nested upper cylinders may be positioned adjacent the group of nested lower cylinders in an interlacing, fingerlike relationship, and disposed for counter rotation relative to one other. Each of the cylinders may include flow apertures adapted for cooperative relationship to establish fluid flow paths.

5 Claims, 11 Drawing Sheets

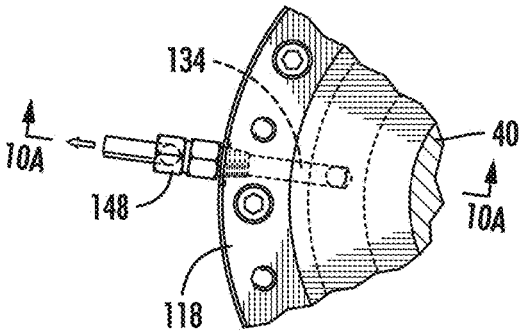
FIG. 10
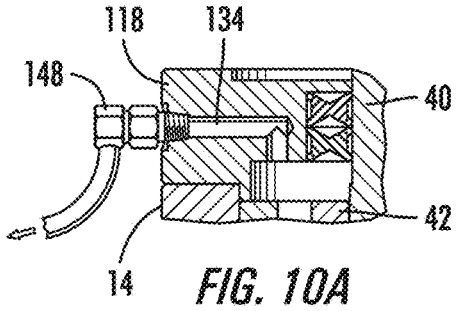
FIG. 10A
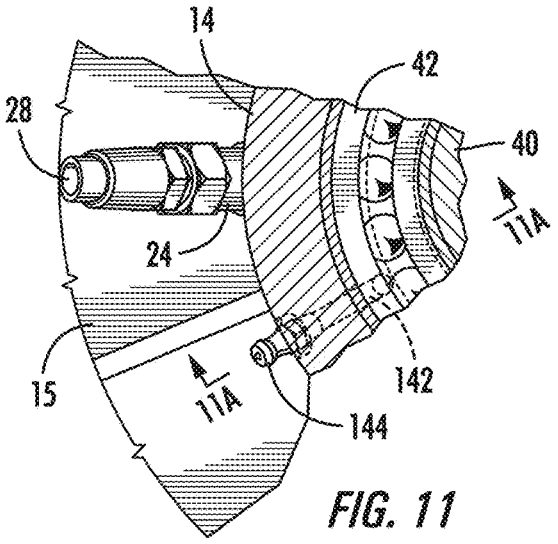
FIG. 11
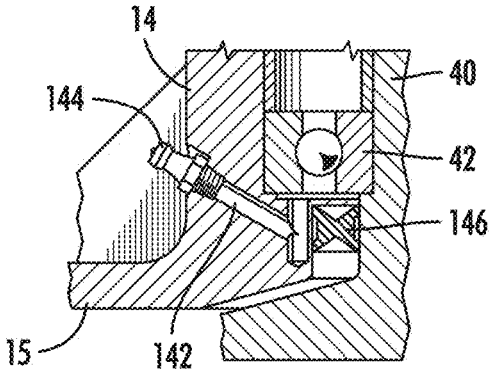
FIG. 11A
FIG. 12
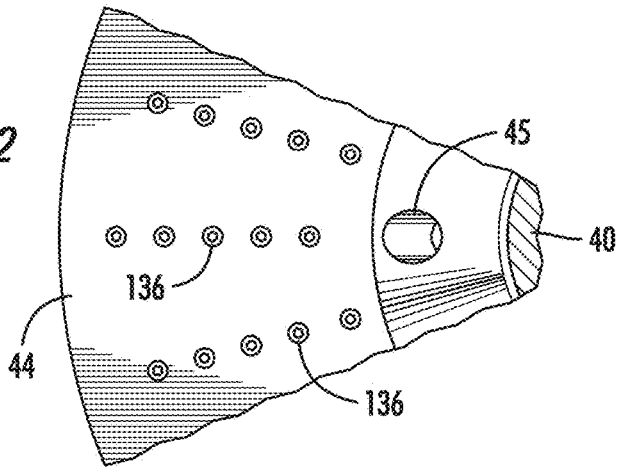

FLUID REFINING SYSTEMS AND METHODS

BACKGROUND OF THE INVENTIONS

1. Field of the Inventions

The present inventions generally pertain to fluid refining systems and method, and more particularly to methods and systems for refining fluid that may be used to clean contaminated fluids and may also be used for circulating or heating fluids in a container.

2. Description of the Related Art

It is known that a broad array of technologies are in existence for refining fluids such as fuel. The present inventions as discussed hereinbelow have been developed to overcome deficiencies in currently-available fuel refining technologies, and to provide more efficient and productive fluid refining systems and methods at a lower cost relative to current technologies that may be used to clean any contaminated fluid, including but not limited to hydrocarbon fuels and water.

SUMMARY OF THE INVENTIONS

In one aspect, the present inventions may include a fluid refining apparatus comprising: an upper motor and a lower motor; an upper housing connected to the upper motor and having at least one upper inlet port; a lower housing connected to the lower motor and having at least one lower inlet port; a central housing connected to and between the upper housing and the lower housing, the central housing including an outlet port, and having an inner chamber in fluid communication with the at least upper inlet port and the at least one lower inlet port; an upper shaft rotatably mounted within the upper housing, the upper shaft having an upper end connected to the upper motor, and at least one upper fluid communication path in fluid communication with the at least one upper inlet port; a lower shaft rotatably mounted within the lower housing, the lower shaft having a lower end connected to the lower motor, and at least one lower fluid communication path in fluid communication with the at least one lower inlet port; a plurality of upper cylinders of gradually increasing diameters extending from an inner upper cylinder to an outer upper cylinder, each of the upper cylinders being spaced apart from its adjacent upper cylinders, including at least one fluid aperture, and connected to the upper shaft; a plurality of lower cylinders of gradually increasing diameters extending from an inner lower cylinder to an outer lower cylinder, each of the lower cylinders being spaced apart from its adjacent lower cylinders, including at least one fluid aperture, and connected to the lower shaft; the plurality of upper and lower cylinders being positioned in interlaced relationship to each other, and the plurality of upper cylinders being adapted for rotation relative to the plurality of lower cylinders. Another feature of this aspect of the present inventions may be that the upper housing includes an upper housing flange, the lower housing includes a lower housing flange, the upper shaft includes an upper annular flange disposed below and adjacent the upper housing flange, and the lower shaft includes a lower annular flange disposed above and adjacent the lower housing flange. Another feature of this aspect of the present inventions may be that the plurality of upper cylinders are connected to the upper annular flange of the upper shaft, and the plurality of lower cylinders are connected to the lower annular flange of the lower shaft. Another feature of this aspect of the present inventions may be that the central housing includes an inner annular wall, an outer wall, and annular flow area between the outer wall and the inner annular wall. Another feature of this aspect of the present inventions may be that the plurality of upper cylinders and the plurality of lower cylinders are disposed within the inner annular wall of the central housing. Another feature of this aspect of the present inventions may be that the inner annular wall includes a plurality of flow ports that establish fluid communication from within the inner annular wall to the annular flow area. Another feature of this aspect of the present inventions may be that each of the upper and lower cylinders includes an annular wall including a plurality of fluid flow apertures. Another feature of this aspect of the present inventions may be that the plurality of upper cylinders are secured to the upper shaft such that the pluralities of fluid flow apertures in the annular walls of the upper cylinders are disposed in aligned relationship to form a plurality of aligned flow paths leading from the inner upper cylinder to the outer upper cylinder; and the plurality of lower cylinders are secured to the lower shaft such that the pluralities of fluid flow apertures in the annular walls of the lower cylinders are disposed in aligned relationship to form a plurality of aligned flow paths leading from the inner lower cylinder to the outer lower cylinder.

In another aspect, the present inventions may include a fluid refining apparatus comprising: an upper motor and a lower motor; an upper housing connected to the upper motor and having at least one upper inlet port; a lower housing connected to the lower motor and having at least one lower inlet port; a central housing connected to and between the upper housing and the lower housing, the central housing including an outlet port, and having an inner chamber in fluid communication with the at least upper inlet port and the at least one lower inlet port, the central housing including an inner annular wall, an outer wall, and annular flow area between the outer wall and the inner annular wall; an upper shaft rotatably mounted within the upper housing, the upper shaft having an upper end connected to the upper motor, and at least one upper fluid communication path in fluid communication with the at least one upper inlet port; a lower shaft rotatably mounted within the lower housing, the lower shaft having a lower end connected to the lower motor, and at least one lower fluid communication path in fluid communication with the at least one lower inlet port; a plurality of upper cylinders of gradually increasing diameters extending from an inner upper cylinder to an outer upper cylinder, each of the upper cylinders being spaced apart from its adjacent upper cylinders, including at least one fluid aperture, and connected to the upper shaft; a plurality of lower cylinders of gradually increasing diameters extending from an inner lower cylinder to an outer lower cylinder, each of the lower cylinders being spaced apart from its adjacent lower cylinders, including at least one fluid aperture, and connected to the lower shaft; the plurality of upper and lower cylinders being positioned in interlaced relationship to each other, and the plurality of upper cylinders being adapted for rotation relative to the plurality of lower cylinders. Another feature of this aspect of the present inventions may be that the upper housing includes an upper housing flange, the lower housing includes a lower housing flange, the upper shaft includes an upper annular flange disposed below and adjacent the upper housing flange, and the lower shaft includes a lower annular flange disposed above and adjacent the lower housing flange. Another feature of this aspect of the present inventions may be that the plurality of upper cylinders are connected to the upper annular flange of the upper shaft, and the plurality of lower cylinders are connected to the lower annular flange of the lower shaft. Another feature of this aspect of the present inventions may be that the plurality of upper cylinders and the plurality of lower cylinders are disposed within the inner annular wall of the central housing. Another feature of this aspect of the present inventions may be that the inner annular wall includes a plurality of flow ports that establish fluid communication from within the inner annular wall to the annular flow area. Another feature of this aspect of the present inventions may be that each of the upper and lower cylinders includes an annular wall including a plurality of fluid flow apertures. Another feature of this aspect of the present inventions may be that the plurality of upper cylinders are secured to the upper shaft such that the pluralities of fluid flow apertures in the annular walls of the upper cylinders are disposed in aligned relationship to form a plurality of aligned flow paths leading from the inner upper cylinder to the outer upper cylinder; and the plurality of lower cylinders are secured to the lower shaft such that the pluralities of fluid flow apertures in the annular walls of the lower cylinders are disposed in aligned relationship to form a plurality of aligned flow paths leading from the inner lower cylinder to the outer lower cylinder.

In yet another aspect, the present inventions may include a fluid refining apparatus comprising: an upper motor and a lower motor; an upper housing connected to the upper motor, the upper housing having at least one upper inlet port and an upper housing flange; a lower housing connected to the lower motor, the lower housing having at least one lower inlet port and a lower housing flange; a central housing connected to and between the upper housing and the lower housing, the central housing including an outlet port, and having an inner chamber in fluid communication with the at least upper inlet port and the at least one lower inlet port; an upper shaft rotatably mounted within the upper housing, the upper shaft having an upper end connected to the upper motor, an upper annular flange disposed below and adjacent the upper housing flange, and at least one upper fluid communication path in fluid communication with the at least one upper inlet port; a lower shaft rotatably mounted within the lower housing, the lower shaft having a lower end connected to the lower motor, a lower annular flange disposed above and adjacent the lower housing flange, and at least one lower fluid communication path in fluid communication with the at least one lower inlet port; a plurality of upper cylinders of gradually increasing diameters extending from an inner upper cylinder to an outer upper cylinder, each of the upper cylinders being spaced apart from its adjacent upper cylinders, including at least one fluid aperture, and connected to the upper annular flange on the upper shaft; a plurality of lower cylinders of gradually increasing diameters extending from an inner lower cylinder to an outer lower cylinder, each of the lower cylinders being spaced apart from its adjacent lower cylinders, including at least one fluid aperture, and connected to the lower annular flange on the lower shaft; the plurality of upper and lower cylinders being positioned in interlaced relationship to each other, and the plurality of upper cylinders being adapted for rotation relative to the plurality of lower cylinders. Another feature of this aspect of the present inventions may be that the central housing includes an inner annular wall, an outer wall, and annular flow area between the outer wall and the inner annular wall. Another feature of this aspect of the present inventions may be that the plurality of upper cylinders and the plurality of lower cylinders are disposed within the inner annular wall of the central housing, and the inner annular wall includes a plurality of flow ports that establish fluid communication from within the inner annular wall to the annular flow area. Another feature of this aspect of the present inventions may be that each of the upper and lower cylinders includes an annular wall including a plurality of fluid flow apertures. Another feature of this aspect of the present inventions may be that the plurality of upper cylinders are secured to the upper shaft such that the pluralities of fluid flow apertures in the annular walls of the upper cylinders are disposed in aligned relationship to form a plurality of aligned flow paths leading from the inner upper cylinder to the outer upper cylinder; and the plurality of lower cylinders are secured to the lower shaft such that the pluralities of fluid flow apertures in the annular walls of the lower cylinders are disposed in aligned relationship to form a plurality of aligned flow paths leading from the inner lower cylinder to the outer lower cylinder.

Other features, aspects and advantages of the present inventions will become apparent from the following discussion and detailed description.

BRIEF DESCRIPTION OF THE DRAWINGS

FIG. 10 is a partial top view of the portion of FIG. 4 indicated as "FIG. 10."

FIG. 10A is a cross-sectional view taken along line 10A-10A of FIG. 10.

FIG. 11 is a partial view of the portion of FIG. 4 indicated as "FIG. 11."

FIG. 11A is a cross-sectional view taken along line 11A-11A of FIG. 11.

FIG. 12 is a partial view of the portion of FIG. 6 indicated as "FIG. 12."

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
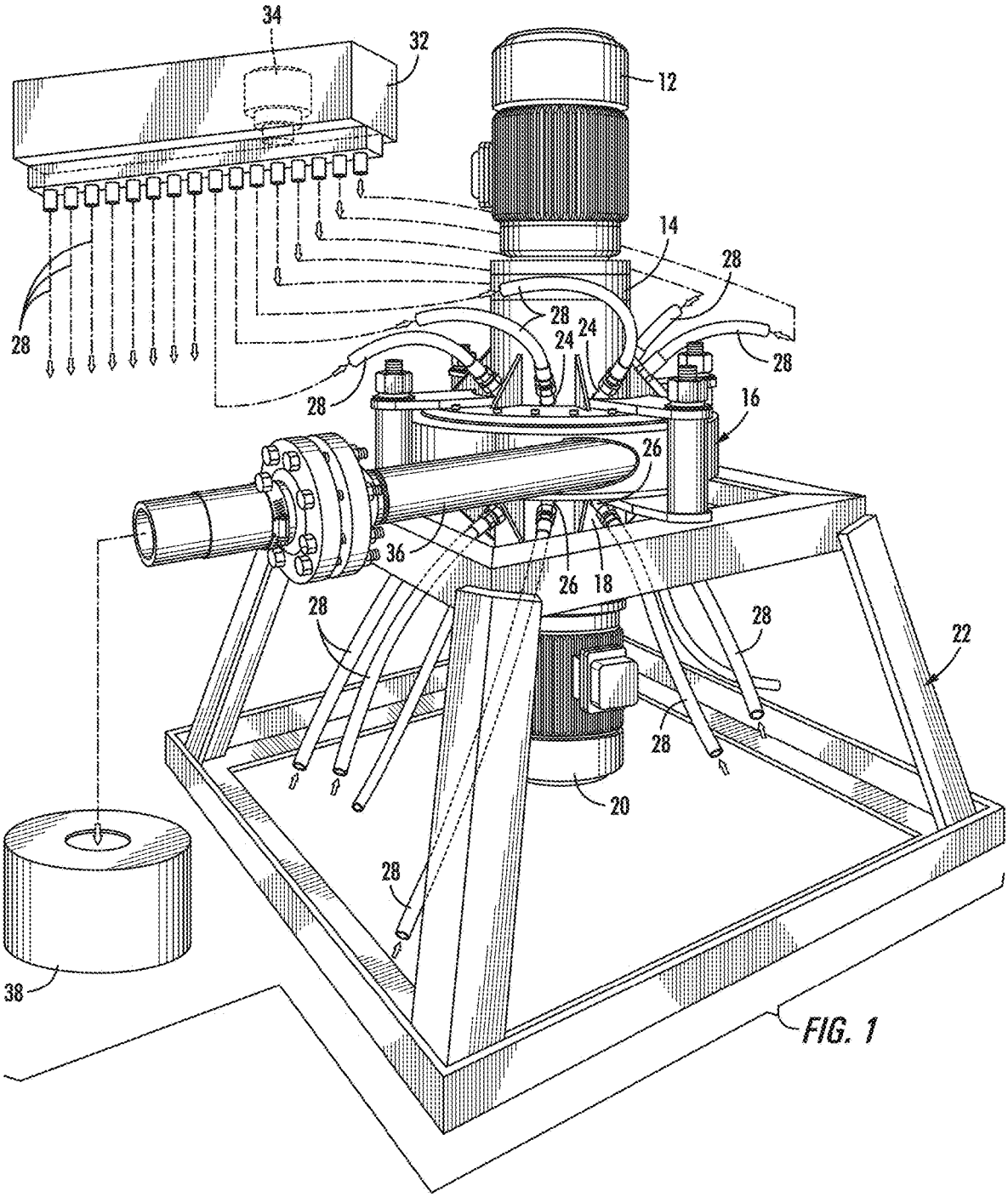
FIG. 1 is a perspective view of a fuel refining apparatus constructed in accordance with one or more aspects of the present inventions.
Figure 2:
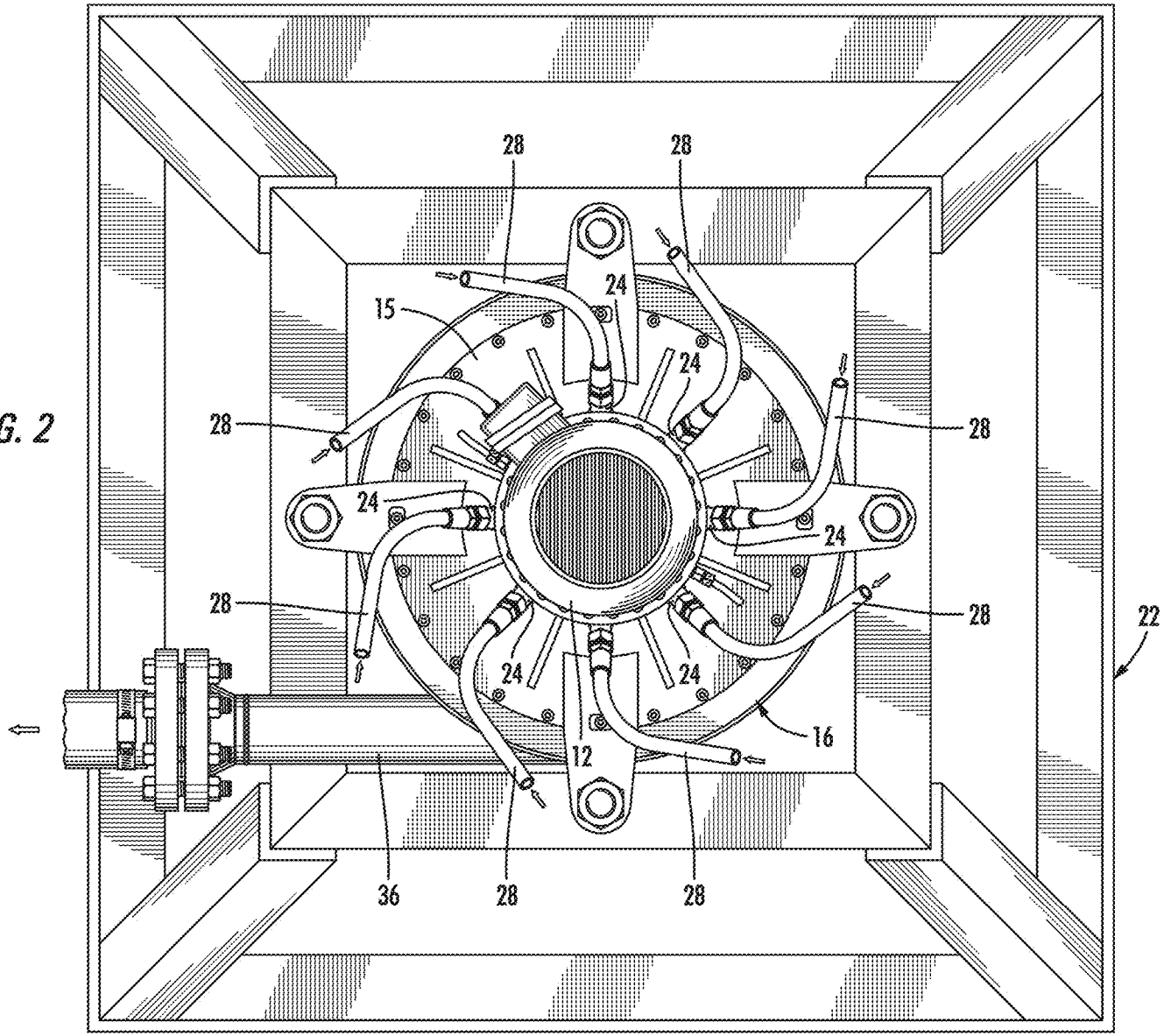
FIG. 2 is a top view of the fuel refining apparatus shown in FIG. 1.
Figure 3:
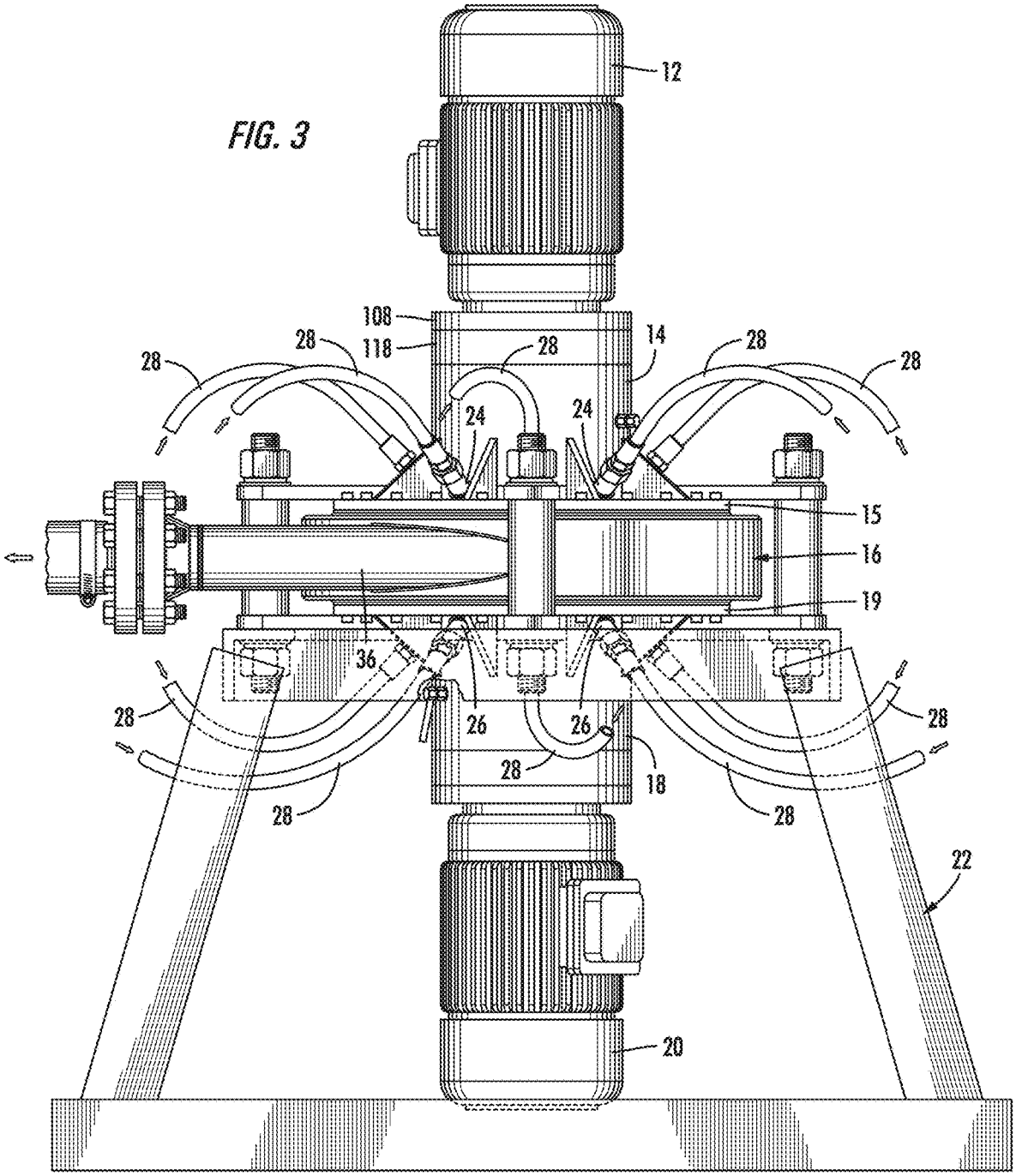
FIG. 3 is a side view of the fuel refining apparatus shown in FIGS. 1 and 2.

Referring to the drawings in detail, wherein like numerals denote identical elements throughout the several views, and referring initially to FIG. 1, there is shown a perspective view of a specific embodiment of a fuel refining apparatus 10 that may include an upper motor 12, an upper housing 14, a central housing 16, a lower housing 18, and a lower motor 20. The apparatus 10 may also include a support frame 22. The upper housing 14 may include a plurality of upper inlet ports 24. The lower housing 18 may include a plurality of lower inlet ports 26. The upper and lower inlet ports 24 and 26 are connected via hoses 28 to a manifold 30 in communication with an inlet reservoir 32. The inlet reservoir 32 may contain a fluid to be treated, such as a hydrocarbon fuel, for example. A pump 34 is provided to pump fluid to be treated from the inlet reservoir 32 through the hoses 28 into the upper and lower inlet ports 24 and 26 in the upper and lower housings 14 and 18, respectively, and into the central housing 16. The central housing 16 may include an outlet port 36 in communication with an outlet reservoir 38. As will be discussed in more detail below, the fluid to be treated that is pumped from the inlet reservoir 32 is subjected to shear forces and refined inside the central housing 16 and then directed through the outlet port 36 to the outlet reservoir 38.

Figure 4:
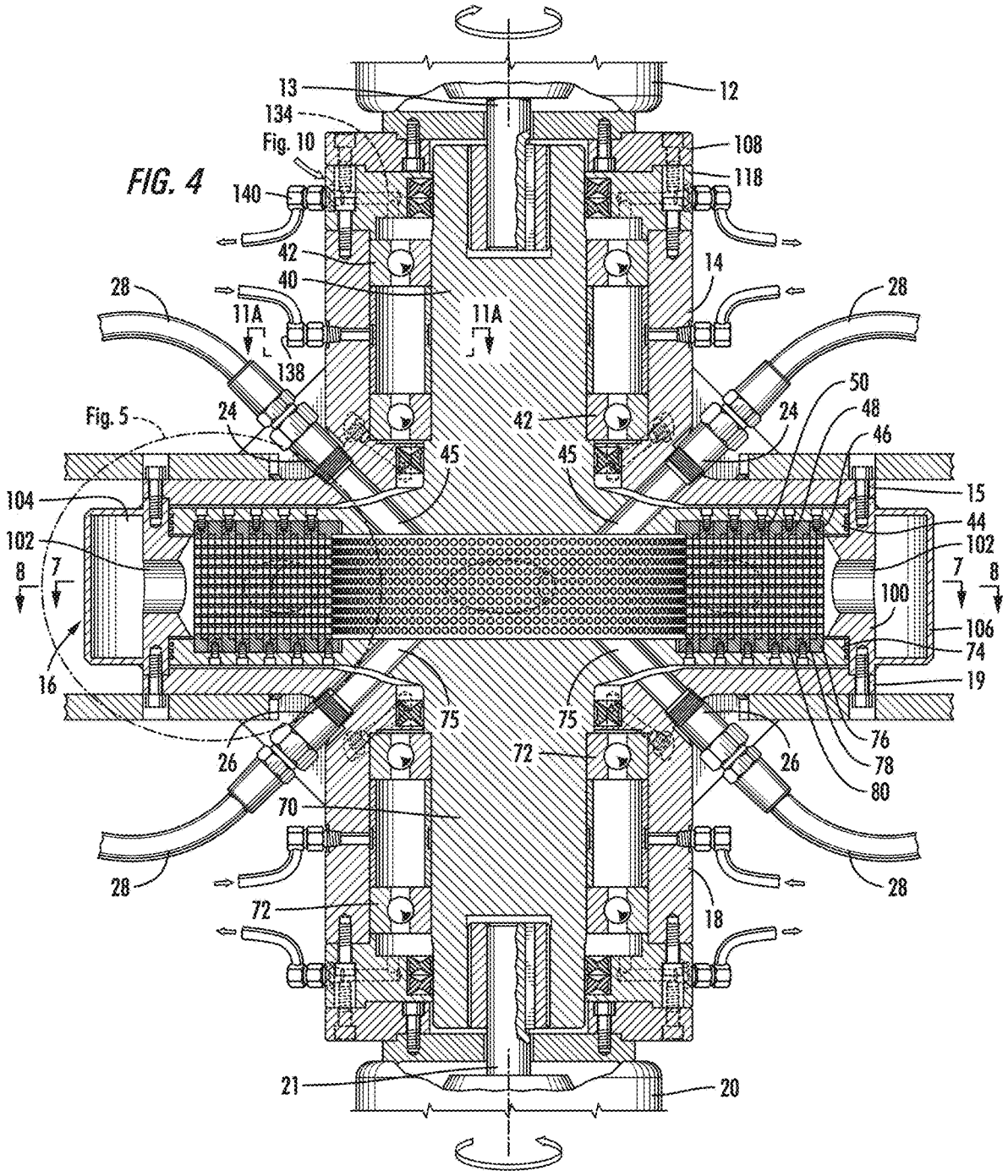
FIG. 4 is a side view in partial cross section of part of the fuel refining apparatus shown in FIGS. 1-3.

Referring to FIG. 4, it can be seen that the fuel refining apparatus 10 may include an upper shaft 40 rotatably mounted to an upper bearing 42 within the upper housing 14. The upper housing 14 may include an upper housing flange 15. An upper end of the upper shaft 40 is engaged to an upper motor shaft 13 in a known manner. A lower end of the upper shaft 40 may include an upper annular flange 44. The upper annular flange 44 on the upper shaft 40 may be disposed below the upper housing flange 15, and may also be in general alignment with and close proximity thereto. The upper annular flange 44 on the upper shaft 40 may include a plurality of upper fluid passageways 45 that may be in general alignment with the upper inlet ports 24 in the upper housing 14 and exit through a lower surface of the upper annular flange 44 on the upper shaft 40.

Figure 5:
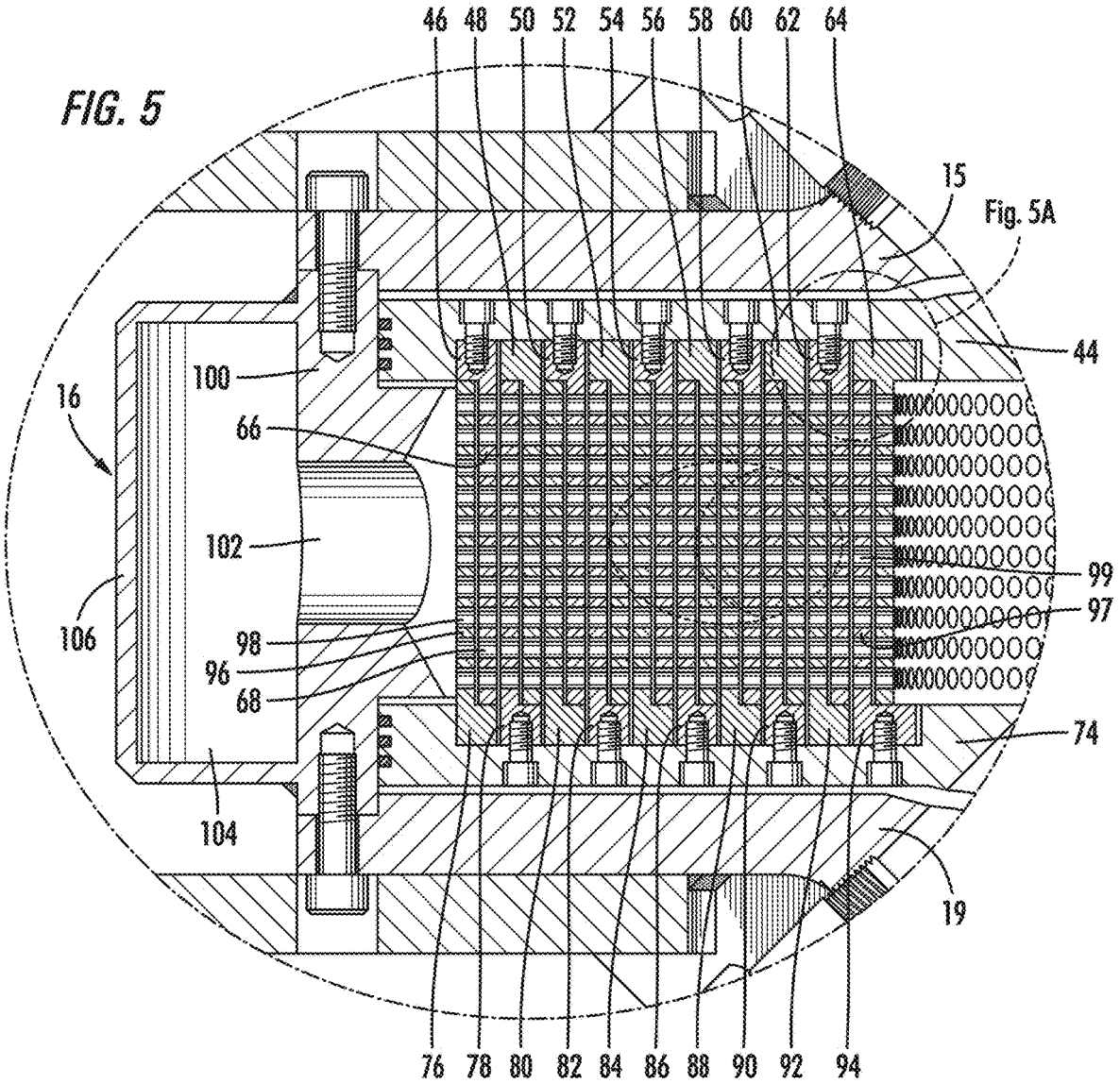
FIG. 5 is an exploded view of the portion of FIG. 4 indicated as "FIG. 5."
Figure 5A:
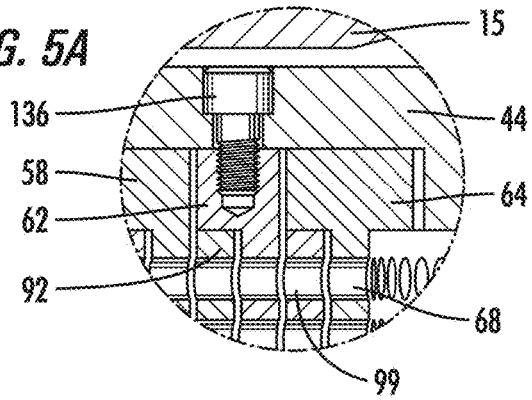
FIG. 5A is an exploded view of the portion of FIG. 5 indicated as "FIG. 5A."

With reference to FIGS. 4 and 5, a plurality of upper cylinders 46-64 are attached to and extend downwardly from the upper annular flange 44 of the upper shaft 40. The upper cylinders 46-64 may be of gradually decreasing diameters starting with the outer upper cylinder 46 and gradually decreasing moving from left to right in FIG. 5. In this manner, the plurality of upper cylinders 46-64 are nested relative to one another. Each of the upper cylinders 46-64 includes an annular wall (such as annular wall 66 on outer upper cylinder 46) and each annular wall includes a plurality of fluid apertures (such as fluid apertures 68 in annular wall 66 of outer upper cylinder 46). In a specific embodiment, when the upper cylinders 46-64 are attached to the upper annular flange 44, each of the fluid apertures in a given upper cylinder may be coaxially aligned with a corresponding fluid aperture in each of the other upper cylinders, to thereby establish an aligned fluid flow path leading from an innermost upper cylinder 64 to the outer upper cylinder 46. In this way, there may be multiple sets of aligned apertures in the plurality of upper cylinders 46-64 establishing multiple aligned fluid flow paths from the innermost upper cylinder 64 to the outer upper cylinder 46.

Referring to FIG. 4, the fuel refining apparatus 10 may include a lower shaft 70 rotatably mounted to a lower bearing 72 within the lower housing 18. The lower housing 18 may include a lower housing flange 19. A lower end of the lower shaft 70 is engaged to a lower motor shaft 21 in a known manner. An upper end of the lower shaft 70 may include a lower annular flange 74. The lower annular flange 74 on the lower shaft 70 may be disposed above the lower housing flange 19, and may also be in general alignment with and close proximity thereto. The lower annular flange 74 on the lower shaft 70 may include a plurality of lower passageways 75 that may be in general alignment with the lower inlet ports 26 in the lower housing 18 and exit through an upper surface 77 of the lower annular flange 74 on the lower shaft 70.

As best seen in FIG. 5, a plurality of lower cylinders 76-94 are attached to and extend upwardly from the lower annular flange 74 of the lower shaft 70. The lower cylinders 76-94 may be of gradually decreasing diameters starting with the outer lower cylinder 76 and gradually decreasing moving from left to right in FIG. 5. In this manner, the plurality of lower cylinders 76-94 are nested relative to one another. Each of the lower cylinders 76-94 includes an annular wall (such as annular wall 96 on outer lower cylinder 96) and each annular wall includes a plurality of fluid apertures (such as fluid apertures 98 in annular wall 96 of outer lower cylinder 76). In a specific embodiment, when the lower cylinders 76-94 are attached to the lower annular flange 74, each of the fluid apertures in a given lower cylinder may be coaxially aligned with a corresponding fluid aperture in each of the other lower cylinders, to thereby establish an aligned fluid flow path leading from an innermost lower cylinder 94 to the outer lower cylinder 76. In this way, there may be multiple sets of aligned apertures in the plurality of lower cylinders 76-94 establishing multiple aligned fluid flow paths from the innermost lower cylinder 94 to the outer lower cylinder 76.

The upper cylinders 46-64 are adapted for interlacing engagement with the lower cylinders 76-94, as shown for example in FIGS. 4 and 5. This can further be seen, for example, from FIG. 6, which shows the upper cylinders 46-64 spaced above and separated from the lower cylinders 76-94, before they have been moved into interlacing engagement, like the fingers of two hands meshing together. Now with reference to FIGS. 4 and 5, the upper housing 14 has been lowered down and secured to the central housing 16 with the upper cylinders 46-64 inserted into annular spaces between the lower cylinders 76-94. The upper housing 14 is secured to an upper side of the central housing 16, such as with bolts as shown for example in FIGS. 4 and 5. The lower housing 18 is likewise secured to a lower side of the central housing 16, such as with bolts as shown in FIGS. 4 and 5. When in this assembled configuration, each of the multiple sets of aligned apertures in the upper cylinders 46-64 are aligned with corresponding multiple sets of aligned apertures in the lower cylinders 76-94 to establish multiple aligned fluid flow paths leading from the innermost upper cylinder 64 to the outermost lower cylinder 76.

In operation, the upper motor 12 rotates the upper shaft 40 and attached upper cylinders 46-64 in a first direction, while at the same time the lower motor 20 rotates the lower shaft 70 and attached lower cylinders 76-94 in a second direction, which is opposite of the first direction. In other words, the upper cylinders 46-64 and lower cylinders 76-94 rotate in opposite directions. While upper cylinders 46-64 and lower cylinders 76-94 are rotating in opposite directions, fluid to be treated is pumped from the inlet reservoir 32 through the hoses 28, through the inlet ports 24 and 26, through the fluid passageways 45 and 75, and into a chamber defined between the upper and lower annular flanges 44 and 74 and the innermost upper cylinder 64. From there the fluid is pumped through the apertures in the upper cylinders 46-64 and lower cylinders 76-94. The fluid is subjected to shear forces imparted as a result of the counter-rotating upper cylinders 46-64 and lower cylinders 76-94.

Figures 7, 7A:
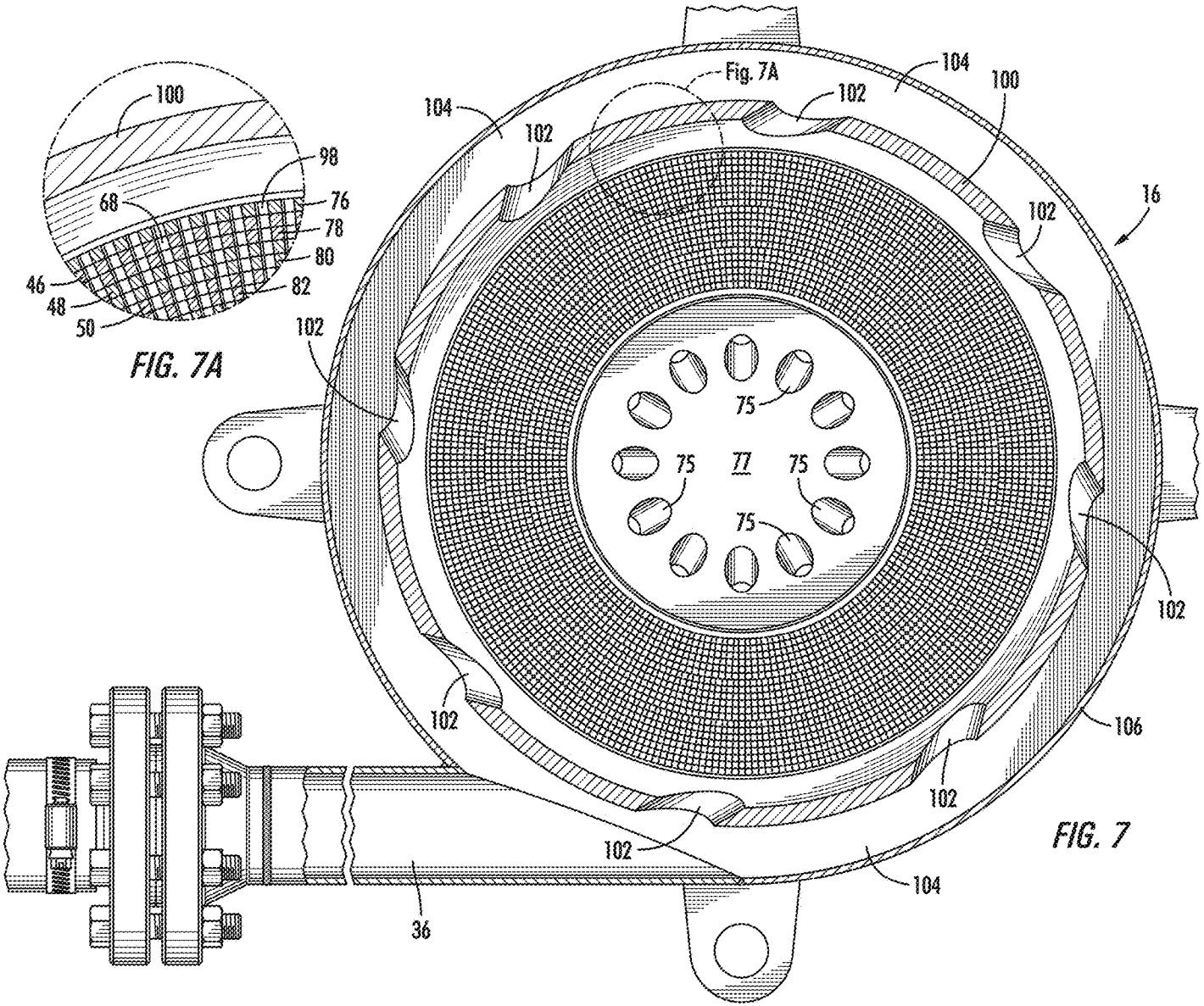
FIG. 7 is a cross-sectional view taken along line 7-7 in FIG. 4.
FIG. 7A is an exploded view of the portion of FIG. 7 indicated as "FIG. 7A."
Figures 8, 8A:
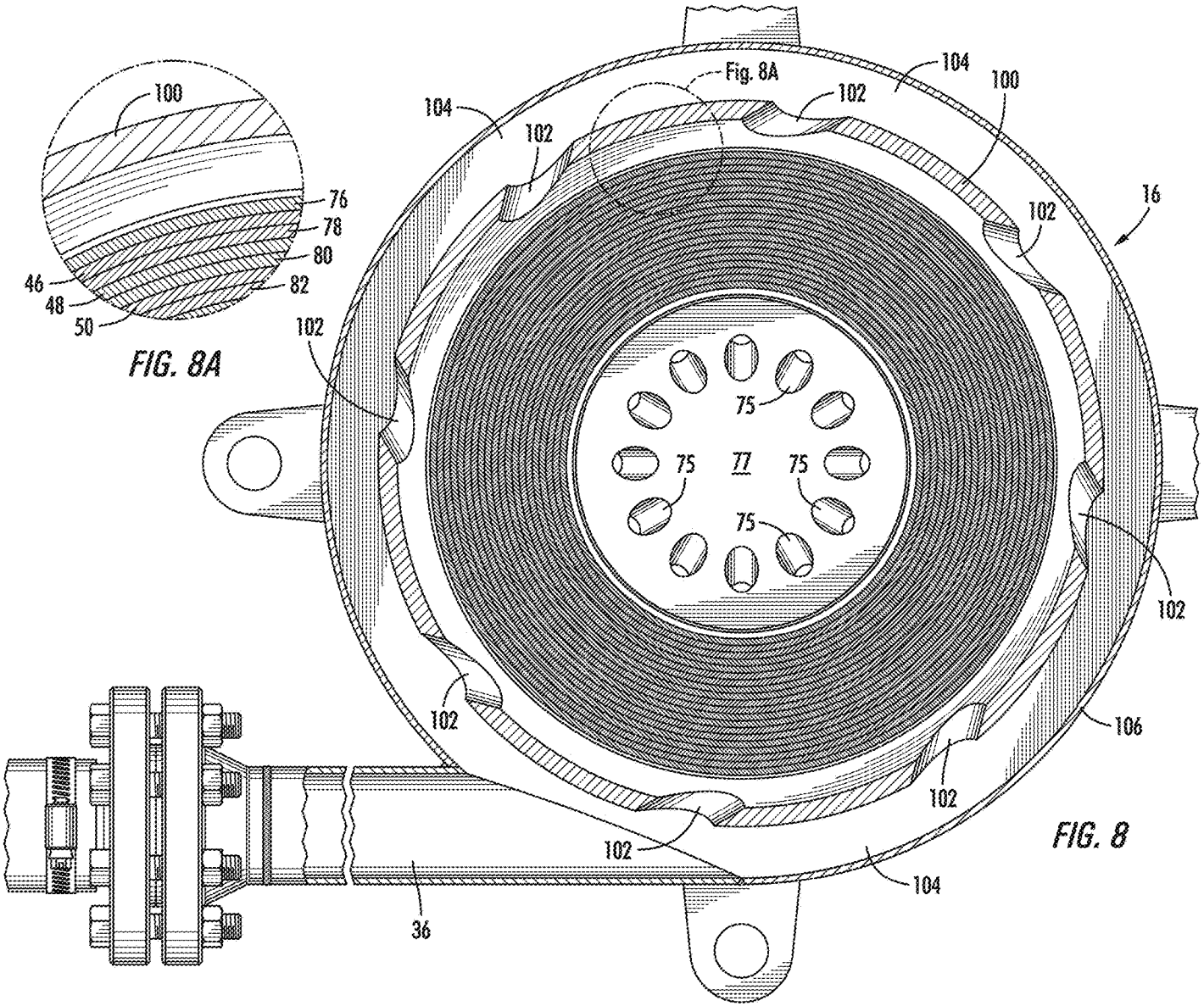
FIG. 8 is a cross-sectional view taken along line 8-8 of FIG. 4.
FIG. 8A is an exploded view of the portion of FIG. 8 indicated as "FIG. 8A."

As shown for example in FIGS. 7 and 8, the central housing 16 includes an inner annular wall 100 having a plurality of exit ports 102. The interlaced upper cylinders 46-64 and lower cylinders 76-94 are disposed within the inner annular wall 100. The central housing 16 includes an annular flow area 104 between the inner annular wall 100 and an outer wall 106 of the central housing 16. The annular flow area 104 is in fluid communication with the outlet port 36 of the central housing 16. The sheared fluid exiting the apertures in the upper cylinders 46-64 and the lower cylinders 76-94 is pumped through the exit ports 102 in the inner annular wall 100 and into the annular flow area 104 and out through the outlet port 36 to the outlet reservoir 38.

Figure 9:
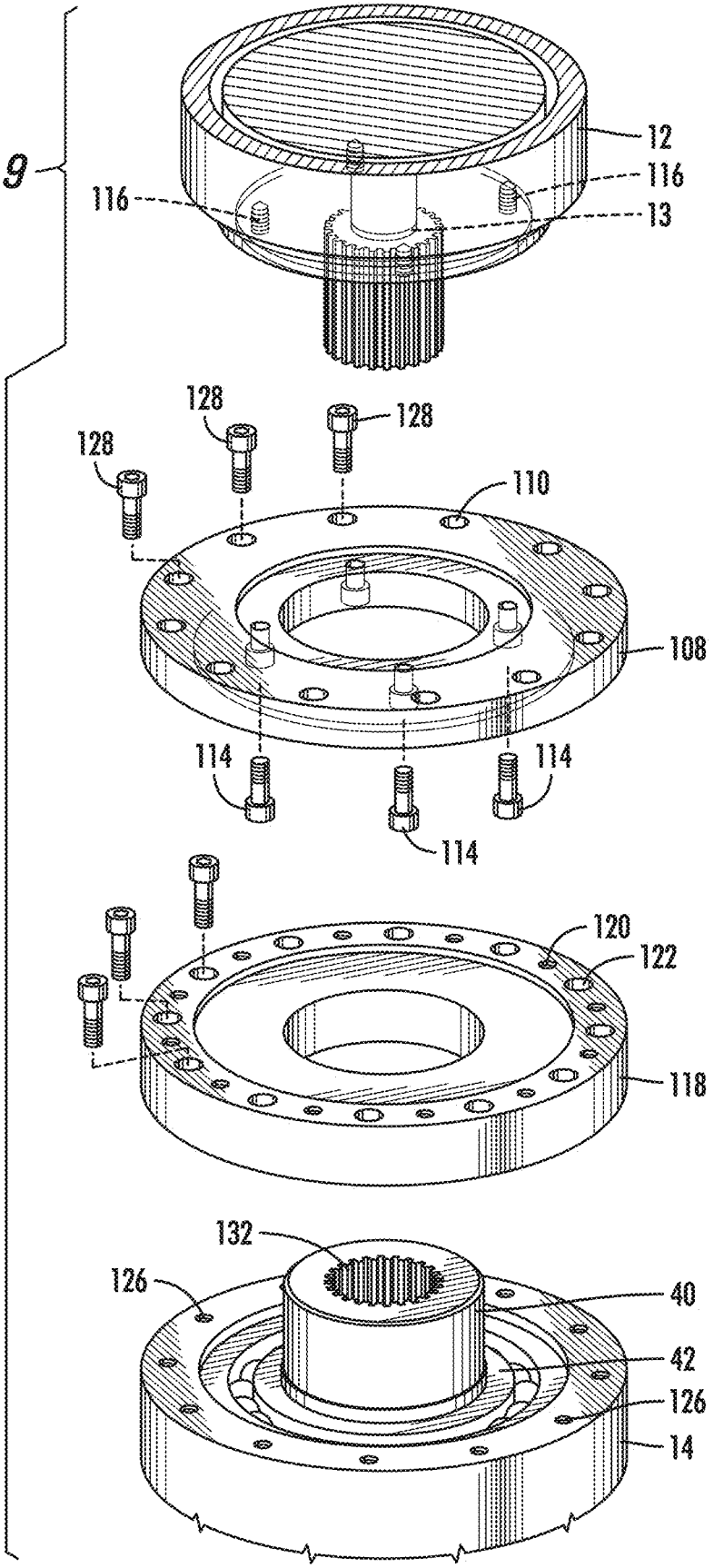
FIG. 9 is an exploded view illustrating a specific embodiment of how upper and lower motors may be attached to their corresponding upper and lower housings and upper and lower motor shafts, respectively.
Figure 13:
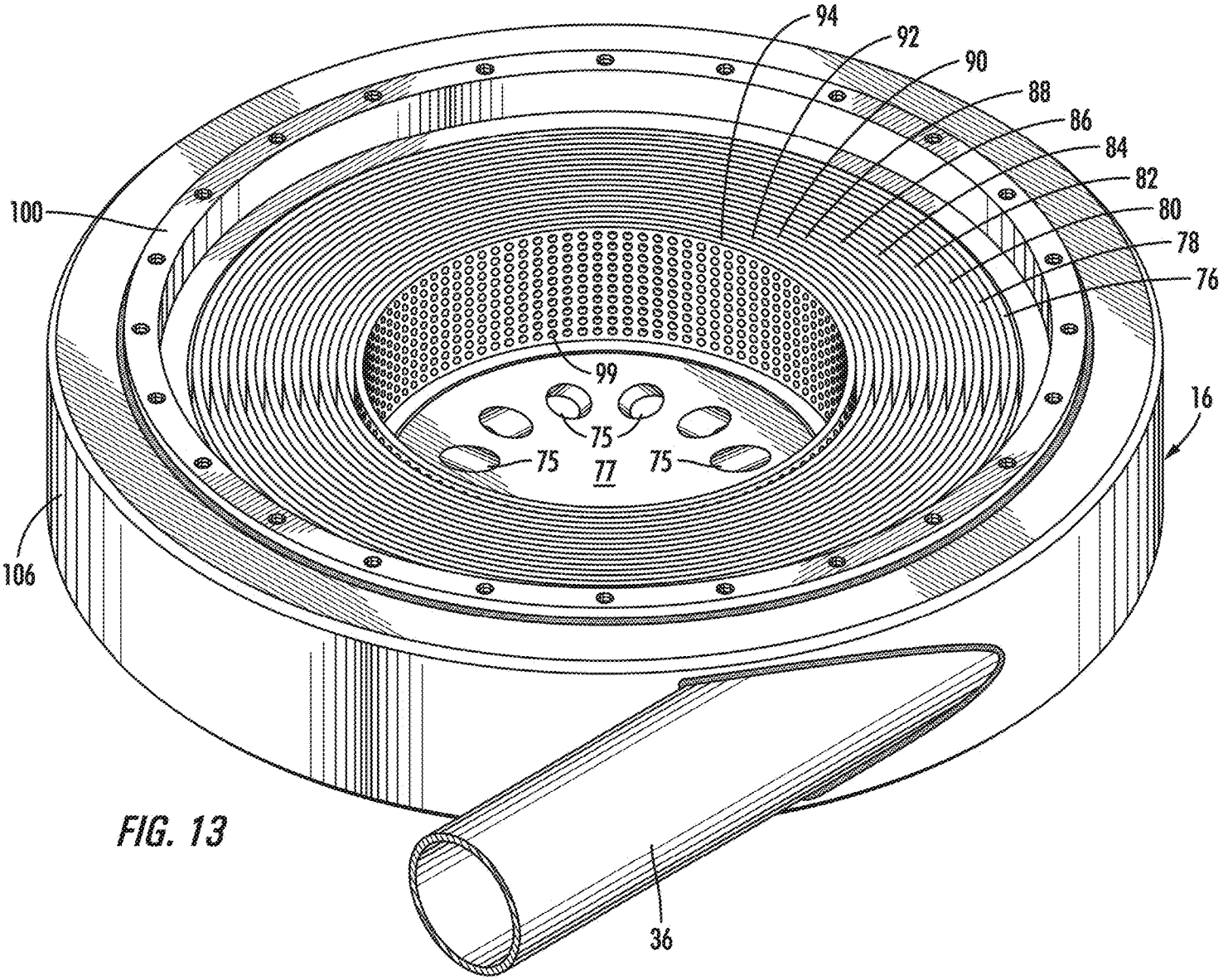
FIG. 13 is a perspective view of a specific embodiment of a central housing (not connected to an upper or lower housing) and showing the top portion open to illustrate specific embodiments of lower cylinders when not meshed with upper cylinders.

FIG. 9 is an exploded view illustrating a specific embodiment of how the upper motor 12 may be secured to the upper housing 14 and the upper shaft 40. An upper mounting ring 108 may include a plurality of outer bolt holes 110 and a plurality of inner bolt holes 112. Lower bolts 114 are passed upwardly through the inner bolt holes 112 and threadably engaged with threaded holes 116 in a lower face of the upper motor 12 so as to secure the upper mounting ring 108 to the upper motor 12. A lower mounting ring 118 is shown beneath the upper mounting ring 108. An upper annular face of the lower mounting ring 118 is shown with a plurality of alternating threaded holes 120 and countersunk holes 122. Housing bolts 124 are provided to pass downwardly through the countersunk holes 122 and threadably secured with threaded holes 126 in an upper annular surface of the upper housing 14 to secure the lower mounting ring 118 to the upper housing 14. Upper bolts 128 pass downwardly through the outer bolt holes 110 in the upper mounting ring 108 and threadably secured to the threaded holes 120 in the upper surface of the lower mounting ring 118 to secure the upper mounting ring 108 to the lower mounting ring 118. A splined shaft 130 on the upper motor 12 is engaged with a splined bore 132 on the upper shaft 40.

FIG. 10 is a partial top view of the section indicated in the upper left portion of FIG. 4. FIG. 10A is a cross-sectional view taken along lines 10A-10A of FIG. 10. FIGS. 10 and 10A together illustrate how, in a specific embodiment, the lower mounting ring 118 may include a passageway 134 establishing fluid communication from an outer surface of the lower mounting ring 118 and an inner bore of the upper housing 14. The leading section of the passageway 134 adjacent the outer surface of the lower mounting ring 118 may be threaded. FIGS. 4, 10 and 10A together illustrate a specific embodiment of a lubrication system for the upper bearing 42. Such a lubrication system may include a lubricant reservoir and pump (not shown) that may pump lubricant to the upper bearing 42 via a left lubricant inlet 138. The lubricant will circulate through the upper bearing 42 and out through the passageway 134 and a left lubricant outlet 140 and then back to the lubricant reservoir and pump. The right side of the upper housing includes an additional lubricant inlet and lubricant outlet that may also be connected to the lubrication system. The lower housing 18 is also shown with similar sets of left and right side inlet and outlet lubricant ports for connection to the lubrication system.

FIG. 11 is a partial top view of the section indicated in the upper left portion of FIG. 4. FIG. 11A is a cross-sectional view taken along lines 11A-11A of FIG. 11. FIGS. 11 and 11A together illustrate a grease port 142 fitted with a grease nipple 144 adapted to apply grease to a lower bearing seal 146.

Figure 6:
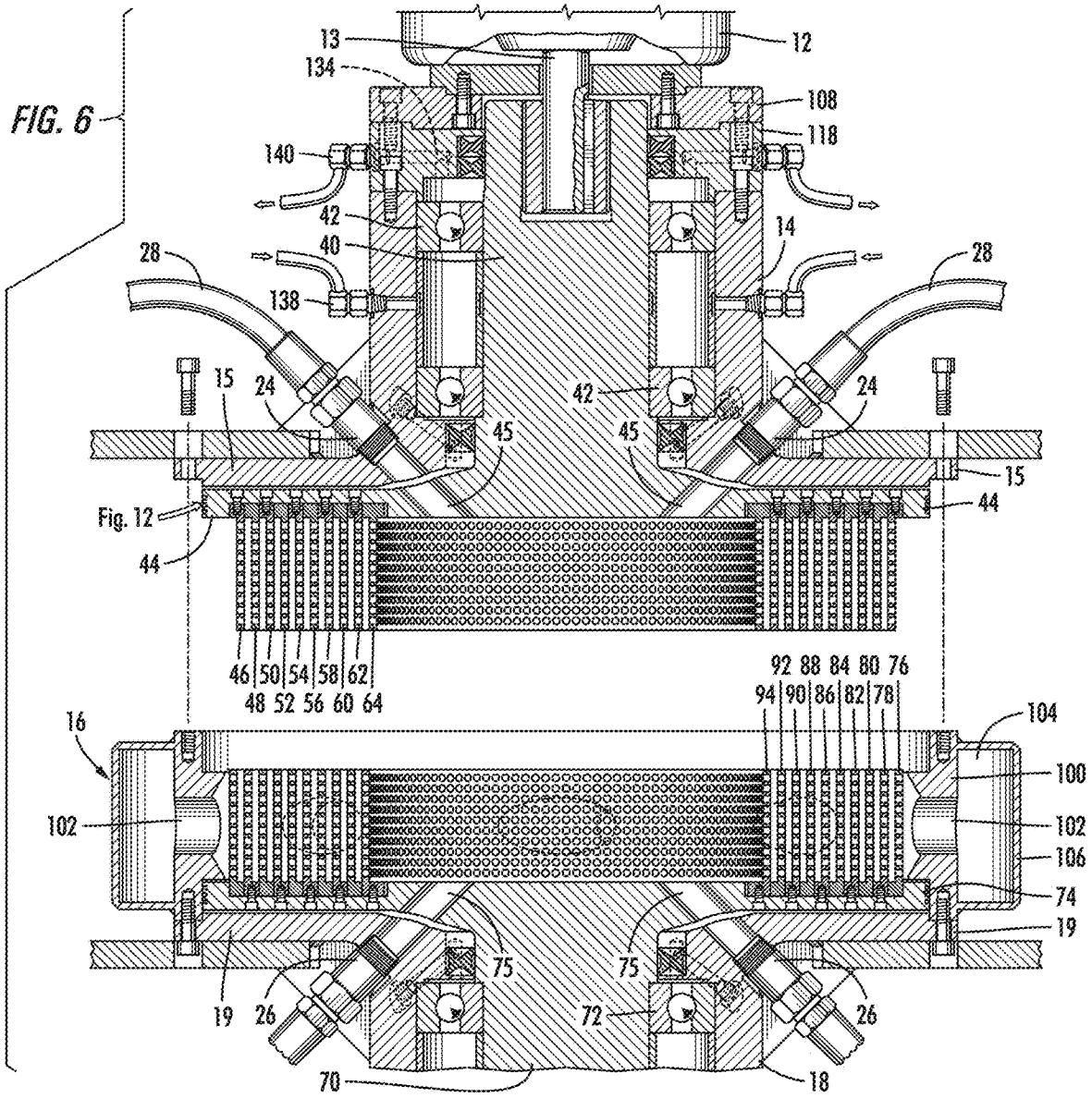
FIG. 6 is a side view in partial cross section similar to FIG. 4 but with an upper section of the apparatus separated from central and lower sections of the apparatus.

FIG. 12 is a partial top view of the section indicated at "FIG. 12" in FIG. 6. FIG. 12 is a top view looking down on top of the upper annular flange 44 of the upper shaft 40. FIG. 12 shows tops of the bolts 136 that are used to secure the upper cylinders 46-64 to the upper annular flange 44 of the upper shaft 40. FIG. 12 also shows one of the upper fluid passageways 45 in the upper annular flange 44, as discussed elsewhere herein above.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. It should also be understood that relative terms such as "upper" and "lower" and "upwardly" and "downwardly" are simply to provide frame of reference and should not be taken as limiting to any particular orientation. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A fluid refining apparatus comprising:

an upper motor and a lower motor;

an upper housing connected to the upper motor, the upper housing having at least one upper inlet port and an upper housing flange;

a lower housing connected to the lower motor, the lower housing having at least one lower inlet port and a lower housing flange;

a central housing connected to and between the upper housing and the lower housing, the central housing including an outlet port, and having an inner chamber in fluid communication with the at least one upper inlet port and the at least one lower inlet port;

an upper shaft rotatably mounted within the upper housing, the upper shaft having an upper end connected to the upper motor, an upper annular flange disposed below and adjacent the upper housing flange, and at least one upper fluid communication path in fluid communication with the at least one upper inlet port;

a lower shaft rotatably mounted within the lower housing, the lower shaft having a lower end connected to the lower motor, a lower annular flange disposed above and adjacent the lower housing flange, and at least one lower fluid communication path in fluid communication with the at least one lower inlet port;

a plurality of upper cylinders of gradually increasing diameters extending from an inner upper cylinder to an outer upper cylinder, each of the upper cylinders being spaced apart from its adjacent upper cylinders, including at least one fluid aperture, and connected to the upper annular flange on the upper shaft;

a plurality of lower cylinders of gradually increasing diameters extending from an inner lower cylinder to an outer lower cylinder, each of the lower cylinders being spaced apart from its adjacent lower cylinders, including at least one fluid aperture, and connected to the lower annular flange on the lower shaft;

the plurality of upper and lower cylinders being positioned in interlaced relationship to each other, and the plurality of upper cylinders being adapted for rotation relative to the plurality of lower cylinders.

2. The fluid refining apparatus of claim 1, wherein the central housing includes an inner annular wall, an outer wall, and an annular flow area between the outer wall and the inner annular wall.

3. The fluid refining apparatus of claim 2, wherein the plurality of upper cylinders and the plurality of lower cylinders are disposed within the inner annular wall of the central housing, and the inner annular wall includes a plurality of flow ports that establish fluid communication from within the inner annular wall to the annular flow area.

4. The fluid refining apparatus of claim 1, wherein each of the upper and lower cylinders includes an annular wall including a plurality of fluid flow apertures.

5. The fluid refining apparatus of claim 4, wherein:

the plurality of upper cylinders are secured to the upper shaft such that the pluralities of fluid flow apertures in the annular walls of the upper cylinders are disposed in aligned relationship to form a plurality of aligned flow paths leading from the inner upper cylinder to the outer upper cylinder; and the plurality of lower cylinders are secured to the lower shaft such that the pluralities of fluid flow apertures in the annular walls of the lower cylinders are disposed in aligned relationship to form a plurality of aligned flow paths leading from the inner lower cylinder to the outer lower cylinder.

* * * * *